US011110479B1

(12) United States Patent
Simmons et al.

(10) Patent No.: US 11,110,479 B1
(45) Date of Patent: Sep. 7, 2021

(54) SPRINKLER WEIGHT

(71) Applicant: Senninger Irrigation, Inc., Clermont, FL (US)

(72) Inventors: Donald P. Simmons, Clermont, FL (US); Jerry D. Lawyer, Clermont, FL (US)

(73) Assignee: Senninger Irrigation, Inc., Clermont, FL (US)

( * ) Notice: Subject to any disclaimer, the term of this patent is extended or adjusted under 35 U.S.C. 154(b) by 17 days.

(21) Appl. No.: 16/800,991

(22) Filed: Feb. 25, 2020

(51) Int. Cl.
*B05B 15/65* (2018.01)
*B05B 3/04* (2006.01)
*B05B 1/26* (2006.01)

(52) U.S. Cl.
CPC ..... *B05B 15/65* (2018.02); *B05B 1/265* (2013.01); *B05B 3/0486* (2013.01)

(58) Field of Classification Search
CPC ..... B05B 15/65; B05B 1/265; B05B 3/0486
USPC ..... 239/222.11, 222.17, 222.21, 600
See application file for complete search history.

(56) References Cited

U.S. PATENT DOCUMENTS 3,189,283 A * 6/1965 Moore ..... C02F 3/043 239/222.17
3,799,453 A 3/1974 Hart
5,234,169 A 8/1993 McKenzie
5,699,962 A 12/1997 Scott
6,199,771 B1 3/2001 Clerman
6,341,711 B1 1/2002 Sweet
6,382,525 B1 * 5/2002 Santiesteban ..... B05B 1/265 239/222.11
6,439,477 B1 8/2002 Sweet
6,676,038 B2 1/2004 Gressett
6,871,795 B2 3/2005 Anuskiewicz
7,037,960 B2 5/2006 Ukai
7,287,710 B1 10/2007 Nelson
7,562,833 B2 7/2009 Perkins
7,677,475 B2 * 3/2010 Lawyer ..... B05B 1/265 239/600
7,942,345 B2 * 5/2011 Sesser ..... B05B 3/008 239/222.21
8,028,932 B2 * 10/2011 Sesser ..... B05B 3/008 239/222.21
8,556,196 B2 10/2013 Lawyer et al.
8,584,969 B2 11/2013 Drechsel
8,991,724 B2 3/2015 Sesser
2011/0155827 A1 6/2011 Dreschel
2013/0327846 A1 12/2013 Sesser

* cited by examiner

*Primary Examiner* — Steven J Ganey
(74) *Attorney, Agent, or Firm* — Knobbe Martens Olson & Bear LLP

(57) ABSTRACT

A weight for attaching to a sprinkler is disclosed. The weight includes a connector having a passageway for water to flow between a first end and a second end. The first end includes a first coupling. The second end includes an outer surface and an inner surface. The outer surface includes a second coupling and the inner surface includes a third coupling. The connector supports a shell having a chamber. The chamber allows a user to add weight to or subtract weight from the shell. In a first aspect, the weight can be attach in multiple orientations to the same sprinkler. In a second aspect, the weight can be attached to a plurality of sprinklers that have different designs. In either aspect, the weight is considered universal.

21 Claims, 18 Drawing Sheets

SPRINKLER WEIGHT

BACKGROUND

Field

The present application for patent relates to sprinklers for irrigating turf, agriculture, and/or landscaping, and more particularly to a universal weight for connecting to a plurality of different sprinklers and/or to a single sprinkler in multiple orientations.

Description of the Related Art

Irrigation systems typically include water lines, valves, regulators, connectors, and any number of sprinklers. The sprinklers in certain irrigation systems operate using relatively large water flow paths for overhead irrigation of large fields and crops. Sprinklers used for overhead irrigation are suspended above the field or crop by a water line. The water line is further supported by a boom system or other structure which slowly pivots or translates across the field and crop. As the boom system pivots or translates during irrigation, the sprinklers sweep and sway over the field and crop.

Weight is attached to each sprinkler to reduce the degree of sway and maintain a desirable position of each sprinkler relative to the boom system. Weight is added or removed from each sprinkler based on, for example, the water pressure experienced by the sprinkler and the location of the sprinkler along the boom system. Further, many irrigation systems include sprinklers having different designs for attaching weight to the sprinkler. Since a single irrigation system often includes hundreds of sprinklers, an operator installing or changing the weights within the irrigation system is presented with a daunting task due to the level of variability in position along the boom system as well as differences in the designs of sprinklers.

Weights can be manufactured, distributed, and sold separately from the sprinkler and have a variety of different configurations and sizes. Combinations of sprinklers and weights can be incompatible. Accordingly, it would be advantageous if the number of different weights required to match with the sprinklers of the irrigation system could be reduced.

SUMMARY

An aspect of the present invention involves a weight for attaching to a sprinkler. The weight comprises a connector having a passageway for water between a first end and a second end. The first end comprises a first coupling. The second end comprises an outer surface and an inner surface. The outer surface comprises a second coupling. The inner surface comprises a third coupling. The weight further comprises a shell having a channel and a chamber. The channel receives a portion of the connector that is located between the first coupling and the second coupling. The chamber is configured to receive powder, granules, gel, liquid, or other forms of material to add mass to the shell. In some embodiments a user can add material or subtract material from the chamber. In some embodiments the chamber is sealed to prevent the user from adding or subtracting material. The weight further comprises engagement structure disposed on the connector and the shell. The engagement structure at least inhibits relative movement between the connector and the shell when the portion of the connector is received within the channel of the shell.

Another aspect is a weight for attaching to a sprinkler. The weight comprises a first end having a first coupling in a form of a first thread and a second end having an outer surface and an inner surface. The outer surface comprises a second coupling in a form of a second thread. The inner surface comprises a third coupling in a form of a third thread. The weight further comprises a passageway for water to flow between the first end and the second end and a chamber configured to confine a material that adds weight.

Another aspect is a weight for attaching to a top end and a bottom end of a single sprinkler. The weight comprises a first end having a first coupling in a form of a first thread and a second end having an outer surface and an inner surface. The outer surface comprises a second coupling in a form of a second thread that engages with the bottom end of the sprinkler. The inner surface comprises a third coupling in a form of a third thread that engages with the top end of the sprinkler. The weight further comprises a passageway for water to flow between the first end and the second end.

The systems and methods of the invention have several aspects and features, no single one of which is solely responsible for all of its desirable attributes. Without limiting the scope of the invention as expressed by the claims, its more prominent aspects have been discussed briefly above. Further aspects and features will also be understood from the description below. Additionally, various aspects and features of the system can be practiced apart from each other. For example, while several of the above-noted aspects of the invention involve a connector for use with a shell, the connect itself can form a separate aspect of the present invention.

BRIEF DESCRIPTION OF THE DRAWINGS

Various embodiments are depicted in the accompanying drawings for illustrative purposes, and should in no way be interpreted as limiting the scope of the embodiments. In addition, various features of different disclosed embodiments can be combined to form additional embodiments, which are part of this disclosure.

DETAILED DESCRIPTION OF CERTAIN EMBODIMENTS

Figure 1:
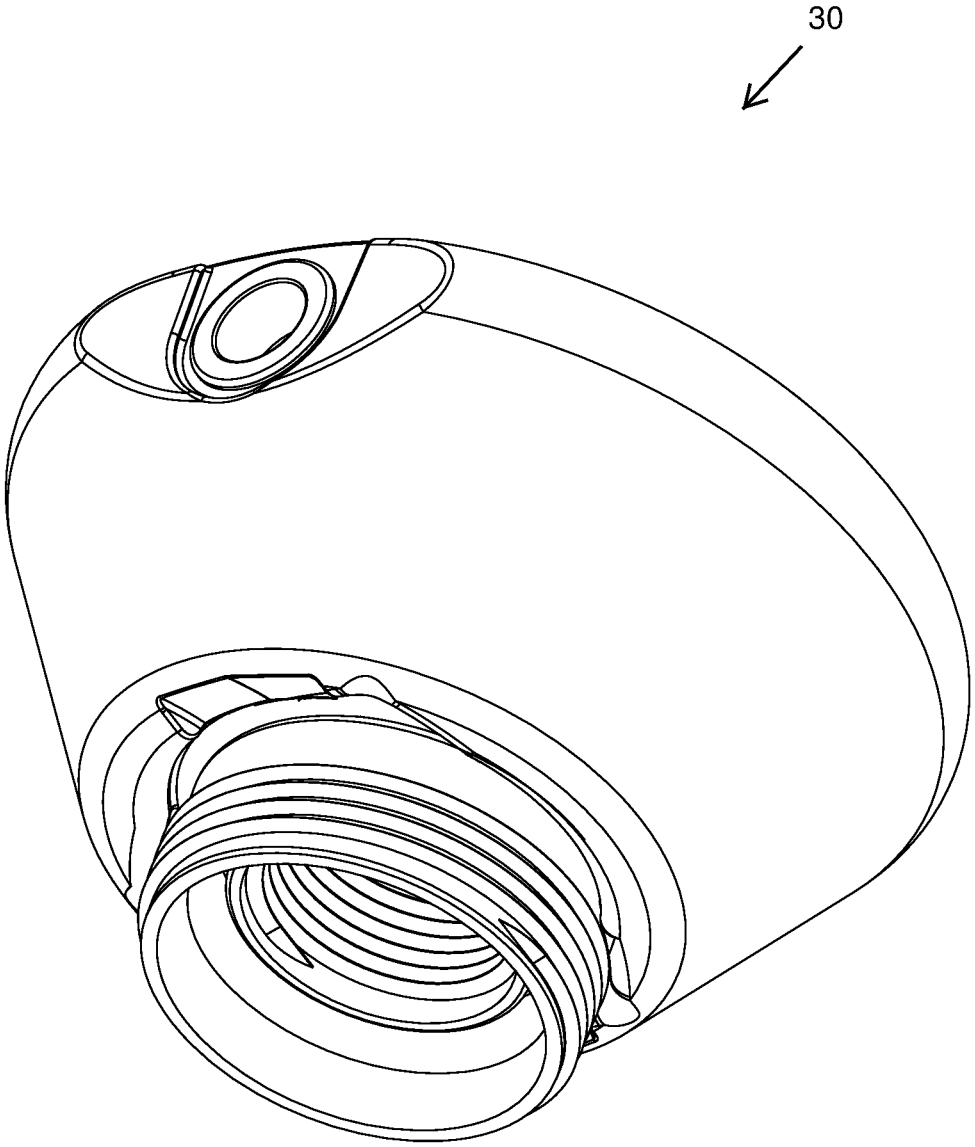
FIG. 1 is a perspective view of a weight that includes a connector and a shell for attachment to a sprinkler according to a preferred embodiment of the present invention.
Figure 2:
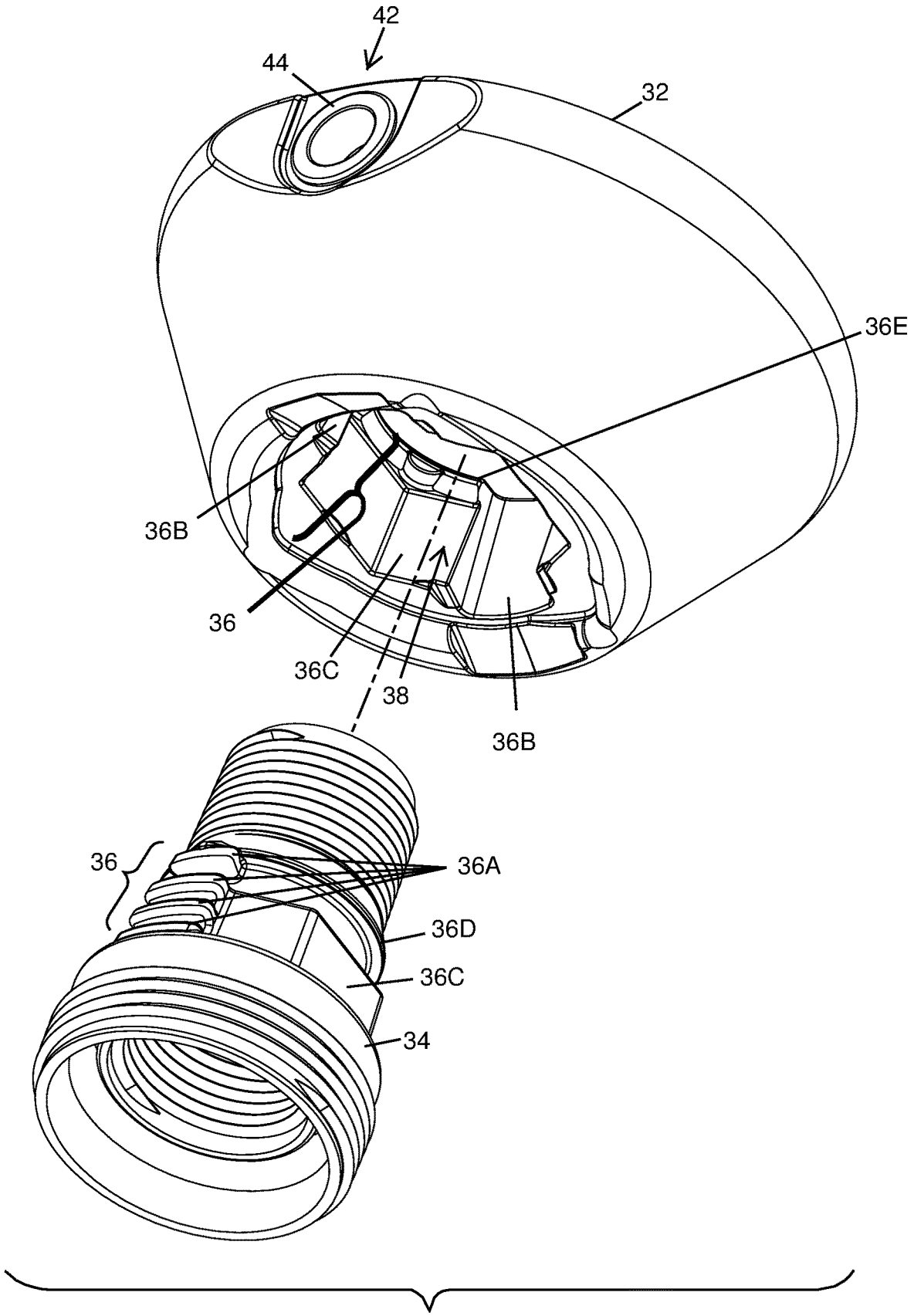
FIG. 2 is an exploded view of the weight from FIG. 1 showing the connector separate from the shell.

FIG. 1 is a perspective view of a weight 30 for use with a sprinkler 70, 80, 90. FIG. 2 is an exploded view of the weight 30 from FIG. 1. In certain embodiments, the weight 30 includes a shell 32 and a connector 34. In certain embodiments, the connector 34 is a hollow substantially cylindrical member made of, for example, plastic or a metal.

In certain embodiments, the shell 32 is supported by the connector 34. In certain embodiments, the shell 32 and the connector 34 are coupled together via one or more engagement structures 36. In certain embodiments, at least one of the one or more engagement structures 36 is disposed on each of the shell 32 and the connector 34 and are complementary to each other.

In certain embodiments, the one or more engagement structures 36 inhibit or prevent relative movement between the connector 34 and the shell 32. For example, in certain embodiments, the one or more engagement structures 36 inhibit relative movement between the connector 34 and the shell 32 in at least one direction (e.g., rotational clockwise, rotational counterclockwise, longitudinal distal, and longitudinal proximal).

In certain embodiments, the shell 32 and the connector 34 are manufactured as a unitary structure. In such an embodiment, the weight 30 need not include the one or more engagement structures 36.

In certain embodiments, the weight 30 is configured in a first aspect to attach in multiple orientations (e.g., right-side up and upside-down) to the same sprinkler and/or in a second aspect to attach to a plurality of sprinklers that have different designs. In either aspect, the weight 30 is considered universal.

Figure 3:
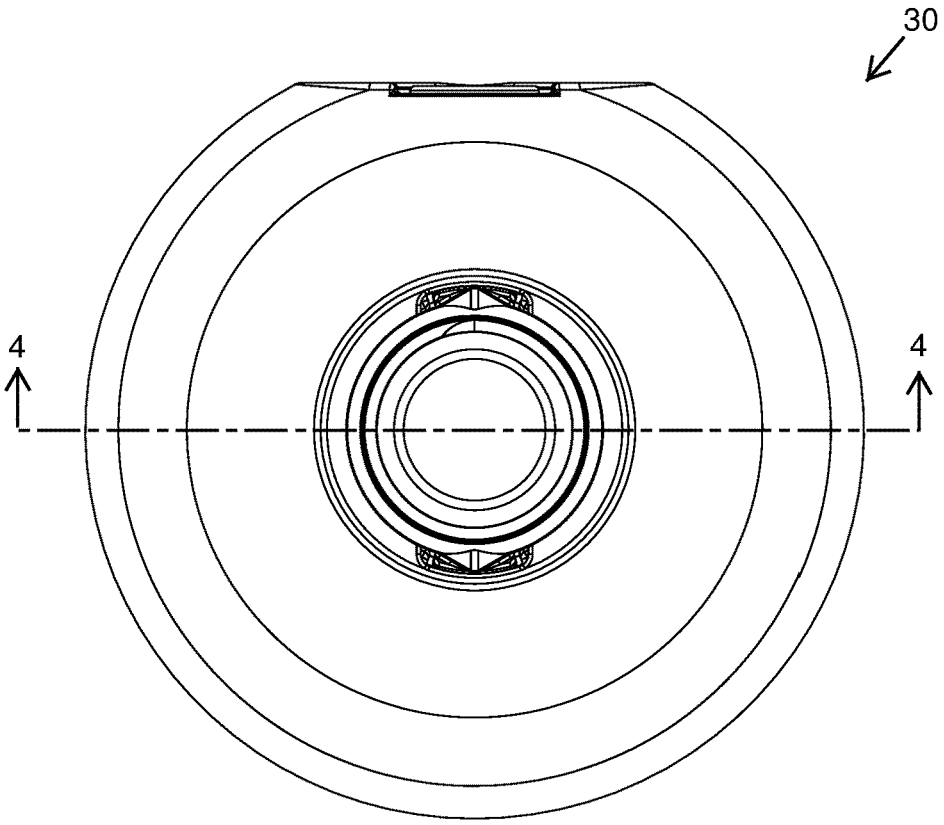
FIG. 3 is a first end view of the weight from FIG. 1.
Figure 4:
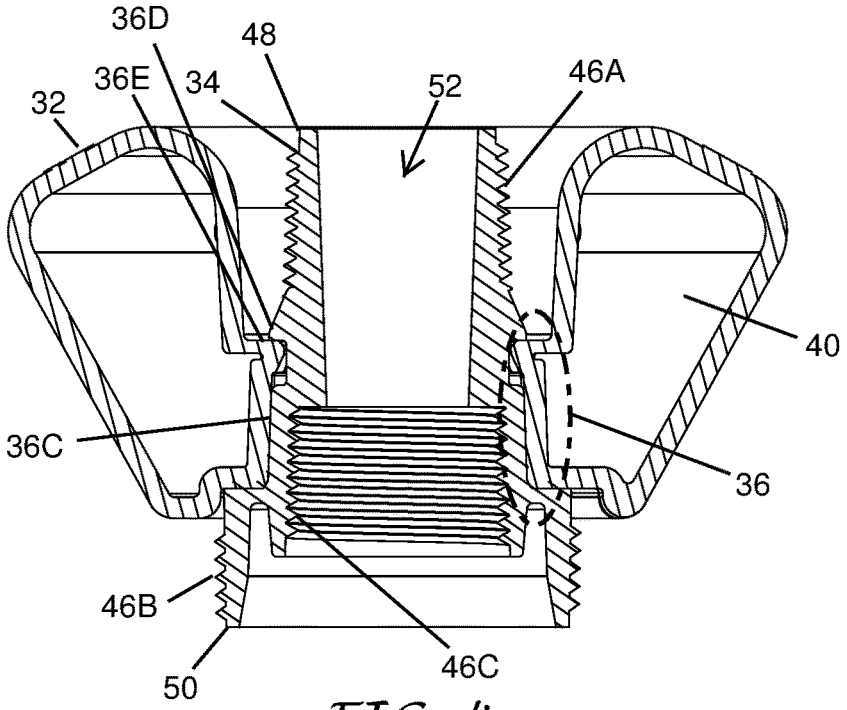
FIG. 4 is a cross-section view of the weight from FIG. 3.

FIG. 3 is a first end view of the weight 30 from FIG. 1. FIG. 4 is a cross-section view of the weight 30 from FIG. 3. In certain embodiments, the shell 32 is hollow forming a chamber 40. In certain embodiments, the shell 32 is made of, for example, plastic or a metal. In certain embodiments, the chamber 40 is configured to be at least partially filled. In certain embodiments, the chamber 40 is configured to confine or support a material that adds weight to the weight 30. In certain embodiments, the chamber 40 is filled with liquid. In certain embodiments, the chamber 40 is filled with a solid. In embodiments where the shell 32 forms the chamber 40, the chamber 40 can be at least partially filled with a liquid and/or solid to add weight to the weight 30. In certain embodiments, the solid is a granular substance that provides the weight. For example, the granular substance can be a material like sand, magnetite, or metal granules or balls, like shot.

In certain embodiments, the shell 32 is roto-molded. In other embodiments, the shell 32 is formed by blow molding. In certain embodiments, the shell 32 is formed by fusing two pieces together.

In certain embodiments, the shell 32 is solid. In this way, a size or density of the shell 32 provides the desired weight without requiring the chamber 40.

In certain embodiments, at least one of the one or more engagement structures 36 is disposed on each of the connector 34 and the shell 32. In certain embodiments, each pair of the one or more engagement structures 36 inhibits or prevents at least one of rotation and longitudinal motion of the connector 34 relative to the shell 32.

Figure 6:
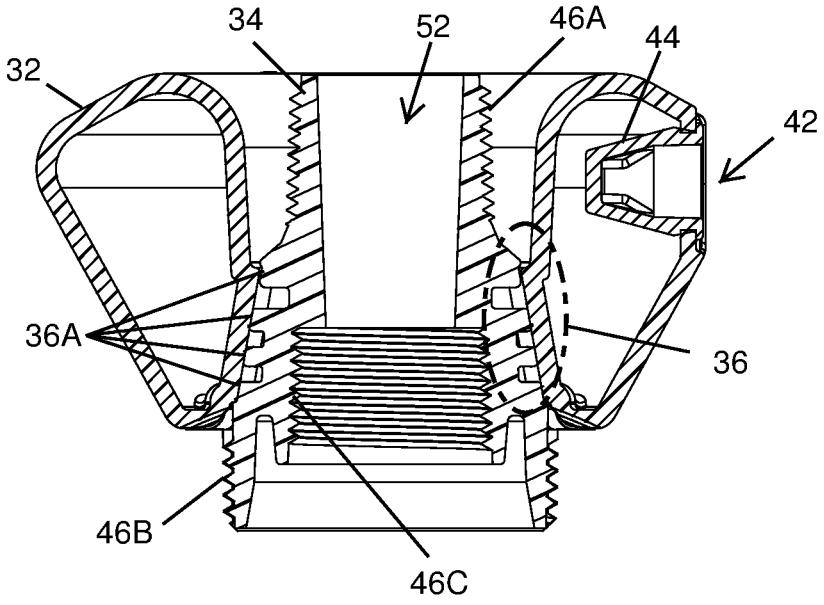
FIG. 6 is a cross-section view of the weight from FIG. 5 taken through a fill port in the shell.

For example, in certain embodiments and as most clearly shown in FIG. 6, one or more of the engagement structures 36 can be one or more ribs 36A on one of the shell 32 and the connector 34 and that is configured to engage with a slot 36B (See FIG. 2) on the other one of the shell 32 and the connector 34. The engagements between the one or more ribs 36A and the slot 36B inhibits or prevents at least one of rotation and longitudinal motion of the connector 34 relative to the shell 32.

In certain embodiments and as most clearly shown in FIG. 4, one or more of the engagement structures 36 can be an outer surface of the connector 34 that includes a flat surface 36C to prevent rotation of the connector 34 relative to another flat surface 36C on the shell 32. In certain embodiments, each of the connector 34 and the shell 32 can include a plurality of the flat surfaces 36C to form complementary hex shapes on the shell 32 and the connector 34 to inhibit relative rotational movement between the shell 32 and the connector 34. In certain embodiments and as most clearly shown in FIG. 4, one or more of the engagement structures 36 can be a barb 36D on one of the shell 32 and the connector 34 and that is configured to be pressed past a lip 36E (see FIG. 2) on the other one of the shell 32 and the connector 34. The engagements between the barb 36D and the lip 36E inhibits or prevents at least one of rotation and longitudinal motion of the connector 34 relative to the shell 32.

In certain embodiments, the shell 32 comprises a channel 38 disposed so as to receive at least a portion of the connector 34 therein. In certain embodiments, the connector 34 has a sufficient length that allows access to both a first end 48 and a second end 50 of the connector 34 when the connector 34 is supported by the shell 32. In certain embodiments, the engagement structure 36 is disposed on the connector 34 at a location between the first end 48 and the second end 50. In certain embodiments, the engagement structure 36 is disposed at a location in the channel 38 of the shell 32.

In certain embodiments, the shell 32 comprises a fill port 42 that extends through a wall of the shell 32 and into the chamber 40. The liquid and/or material can be added to or removed from the chamber 40 via the fill port 42. In certain embodiments that include the fill port 42, the shell 32 can further include a plug 44. The plug 44 can be configured to securely cover the fill port 42 when the fill port 42 is not in use. In certain embodiments, the plug 44 is removable. In certain embodiments, the plug 44 is tethered to the shell 32.

In certain embodiments, the connector 34 comprises a plurality of couplings 46. In certain embodiments, at least one coupling of the plurality of couplings 46 is disposed on each of the first end 48 and the second end 50 of the connector 34. In certain embodiments, at least one of the first and second ends 48, 50 comprises two couplings. For example, the first end 48 of the connector 34 illustrated in FIG. 4 comprises coupling 46A while the second end 50 of the connector 34 comprises coupling 46B and coupling 46C. In the illustrated embodiment, the coupling 46B is disposed on an outer surface of the connector 34 while the coupling 46C is disposed on an inner surface of the connector 34.

In the illustrated embodiment, the plurality of couplings 46 include the couplings 46A, 46B, and 46C. In certain embodiments, the first end 48 of the connector 34 includes an outer surface with an outwardly extending coupling 46A in a form of a thread. In certain embodiments, the outer surface is capable of receiving an appropriately sized connector of another apparatus by mating the thread on the outer surface of the connector 34 with a thread on an inner surface of the connector. In certain embodiments, the other apparatus can be a pressure regulator. In certain embodiments, the coupling 46A is a ¾ inch male NPT.

In certain embodiments, the second end 50 of the connector 34 includes an outer surface with an outwardly extending coupling 46B in a form of a thread. In certain embodiments, the outer surface is capable of receiving an appropriately sized connector of another apparatus by mating the thread on the outer surface of the connector 34 with a thread on an inner surface of the connector. In certain embodiments, the other apparatus can be a sprinkler. In certain embodiments, the coupling 46B is selected to engage the connector on the sprinkler. In certain embodiments, a diameter of the connector on the sprinkler is greater than at least one of the couplings 46A and 46C.

In certain embodiments, the second end 50 of the connector 34 includes an inner surface with an inwardly extending coupling 46C in a form of a thread. In certain embodiments, the inner surface is capable of receiving an appropriately sized connector of another apparatus by mating the thread on the inner surface of the connector 34 with a thread on an outer surface of the connector. In certain embodiments, the other apparatus is a sprinkler. In certain embodiments, the coupling 46C is a ¾ inch female NPT. In certain embodiments, diameters of the couplings 46A and 46C are the same.

Figure 24:
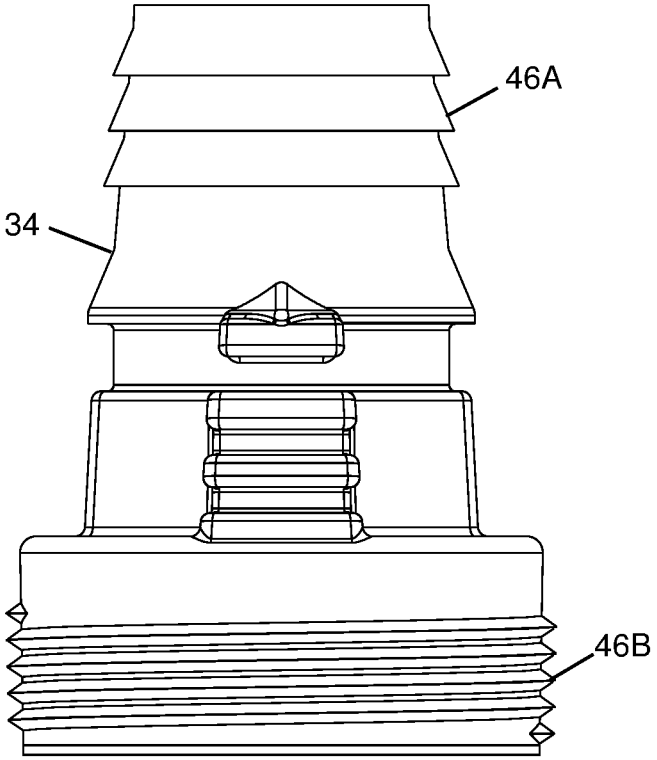
FIG. 24 is a side view of another embodiment of a connector that is similar to the connector illustrated in FIG. 10 except that the connector includes a coupling in the form of at least one barb.

While each of the couplings 46 illustrated in FIG. 4 is a thread, the disclosure is not so limited. One or more of the coupling 46 structures on the connector 34 can be a thread, barb, press-fit, hook, latch, ridge, groove, or any other coupling structure known to a person having ordinary skill in the art and that is complementary to the structure being coupled to by the weight 30 or to couple to the weight 30. Further, the one or more coupling structures 46 on the connector 34 can include a combination of different coupling structures. For example, the embodiment of the connector 34 illustrated in FIG. 24 comprises a combination of different coupling 46 structures. The coupling 46A in FIG. 24 is in the form of at least one barb while the coupling 46B of the same connector 34 is in the form of a thread. In other embodiments, the coupling 46A can be in the form of a thread while the coupling 46B of the same connector 34 can be in the form of at least one barb. While coupling 46C is not shown in FIG. 24, the coupling 46C can also be a thread, barb, press-fit, hook, latch, ridge, groove, or any other coupling structure known to a person having ordinary skill in the art. Thus, the disclosure does not limit the structure of the couplings 46 of the connector 34 to any specific structure.

In certain embodiments, the weight 30 includes one or more seals to facilitate a liquid tight connection between the couplings 46A, 46C of the weight 30 and an inlet line, pressure regulator, and/or sprinkler. The seal can be made of a flexible material such as thermoplastic rubber, nitrile rubber, or etylene-propylene-compound diene rubber. The seal can be substantially cylindrical. The seal can have a diameter selected to be similar to the associated coupling 46A, 46C.

In certain embodiments, the connector 34 comprises a passageway 52. In certain embodiments, the passageway 52 is configured to provide a flow path for water to pass through the weight 30. For example, when the weight 30 is disposed in a water flow path through the sprinkler, the water passes through the passageway 52. Of course when the weight 30 is disposed outside of the water flow path of the sprinkler, the water need not pass through the passageway 52. In this way, in certain embodiments, water need not flow through the passageway 52 in all configurations of the weight 30.

Figure 5:
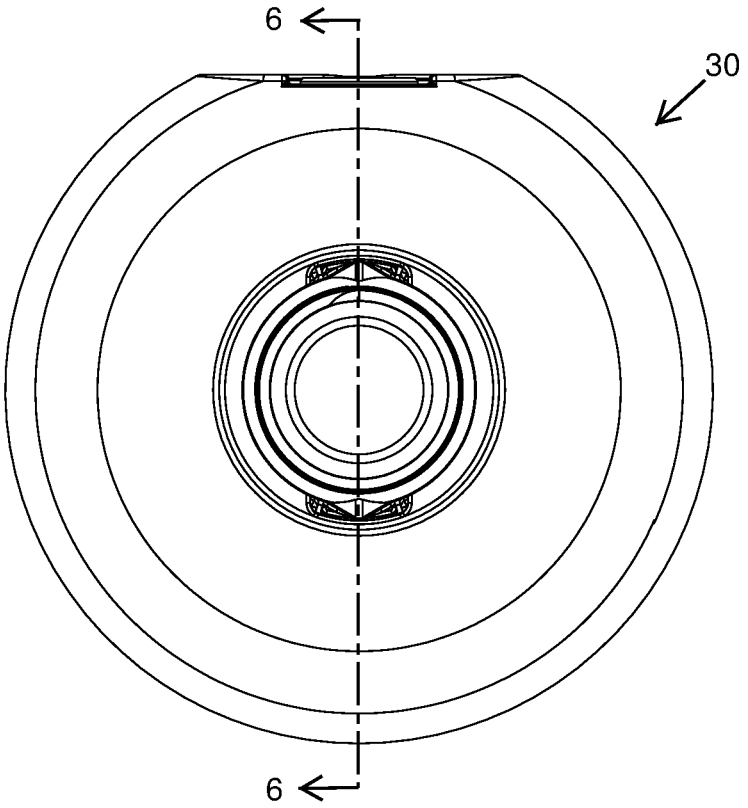
FIG. 5 is another first end view of the weight from FIG. 1.

FIG. 5 is another first end view of the weight 30 from FIG. 1. FIG. 6 is a cross-section view of the weight 30 from FIG. 5 taken through the fill port 42 in the shell 32. In certain embodiments, the fill port 42 extends through a wall of the shell 32 and into the chamber 40. In certain embodiments, the liquid and/or material can be added to or removed from the chamber 40 via the fill port 42.

In certain embodiments that include the fill port 42, the shell 32 can further include the plug 44. The plug 44 can be configured to securely cover the fill port 42 when the fill port 42 is not in use. In certain embodiments, the plug 44 is removable.

FIG. 6 most clearly shows the one or more ribs 36A on the connector 34 engaging with the slot 36B on the shell 32 to inhibit or prevent at least one of rotation and longitudinal motion of the connector 34 relative to the shell 32.

Figure 7:
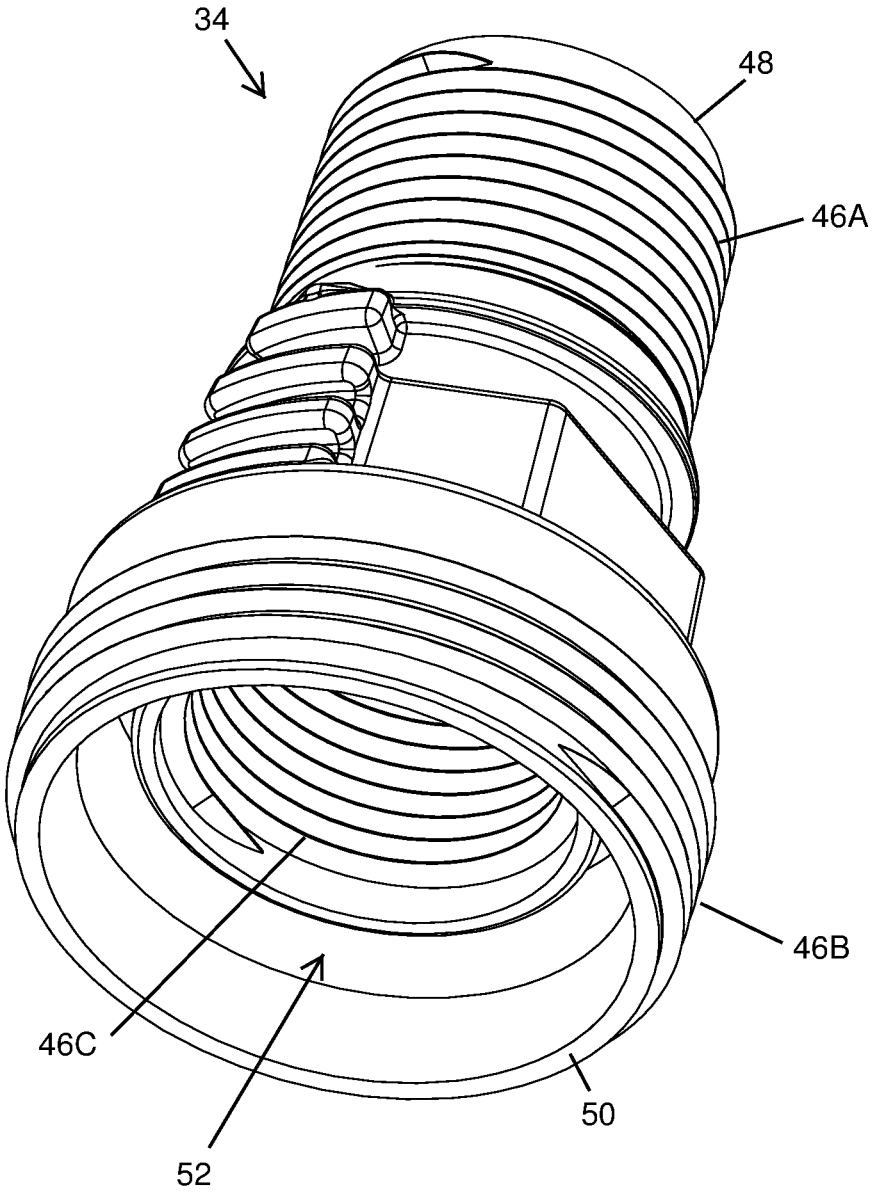
FIG. 7 is a front perspective view of the connector from FIG. 2.
Figure 8:
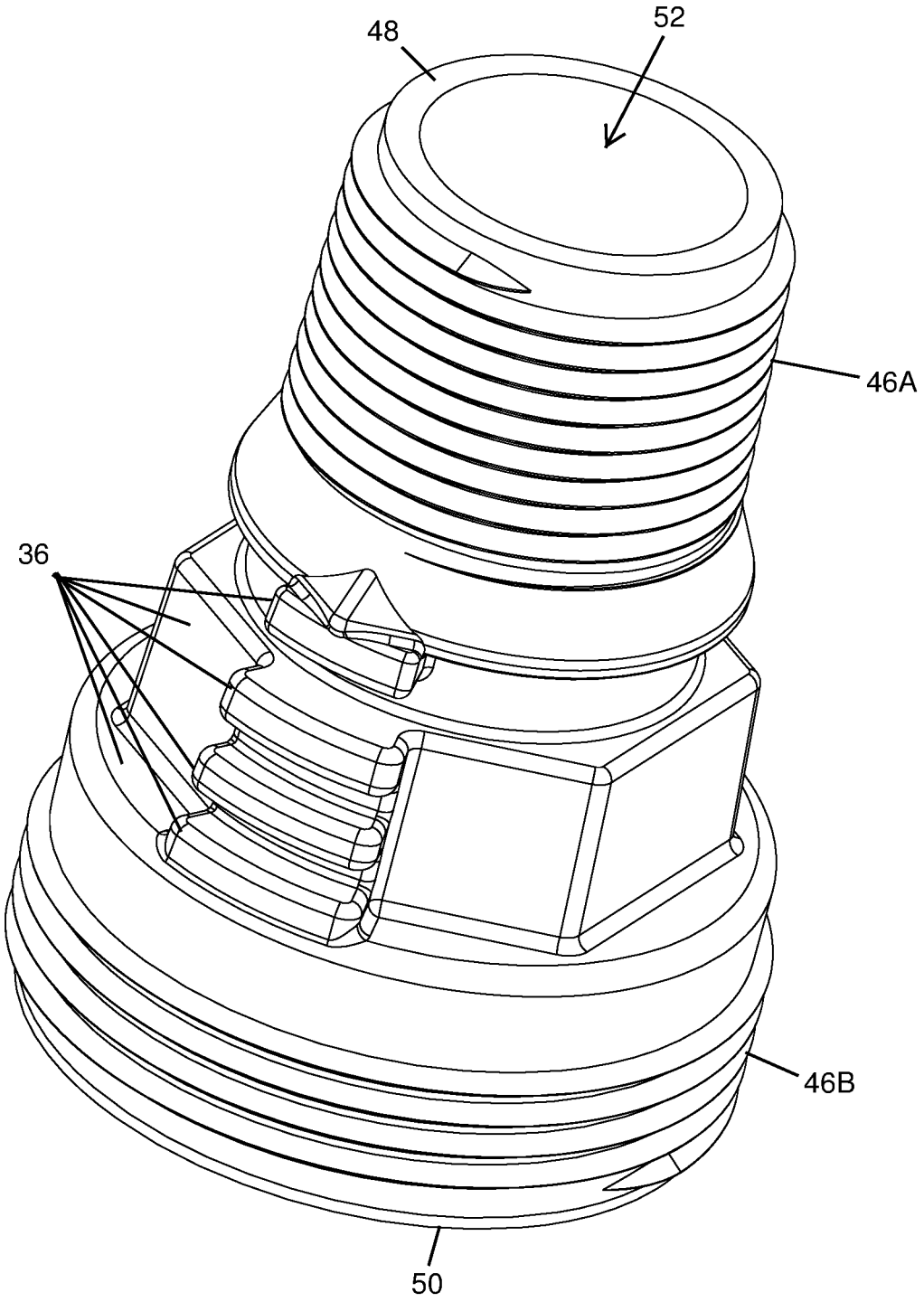
FIG. 8 is a back perspective view of the connector from FIG. 2.

FIGS. 7 and 8 are front and back perspective views of the connector 34 from FIG. 2, respectively. In certain embodiments, the connector 34 comprises the passageway 52 for water to flow between the first end 48 and the second end 50. In certain embodiments, the water flows in either direction between the first end 48 and the second end 50.

In the illustrated embodiment, the outer surface of the first end 48 comprises the coupling 46A. In the illustrated embodiment, the coupling 46A is in the form of the thread. The outer surface is capable of receiving an appropriately sized connector of another apparatus by mating the thread on the outer surface of the connector 34 with a thread on an inner surface of the connector. In certain embodiments, the other apparatus can be a pressure regulator or a water line.

In the illustrated embodiment, the outer surface of the second end 50 comprises the coupling 46B. In the illustrated embodiment, the coupling 46B is in the form of the thread. The outer surface is capable of receiving an appropriately sized connector of another apparatus by mating the thread on the outer surface of the connector 34 with a thread on an inner surface of the connector. In certain embodiments, the other apparatus can be an end of a sprinkler. In certain embodiments, the end is a bottom end of the sprinkler.

In the illustrated embodiment, the inner surface of the second end 50 comprises the coupling 46C. In the illustrated embodiment, the coupling 46C is in the form of the thread. The inner surface is capable of receiving an appropriately sized connector of another apparatus by mating the thread on the inner surface of the connector 34 with a thread on an outer surface of the connector. In certain embodiments, the other apparatus can be an end of the sprinkler. In certain embodiments, the end is a top end of the sprinkler.

Figure 9:
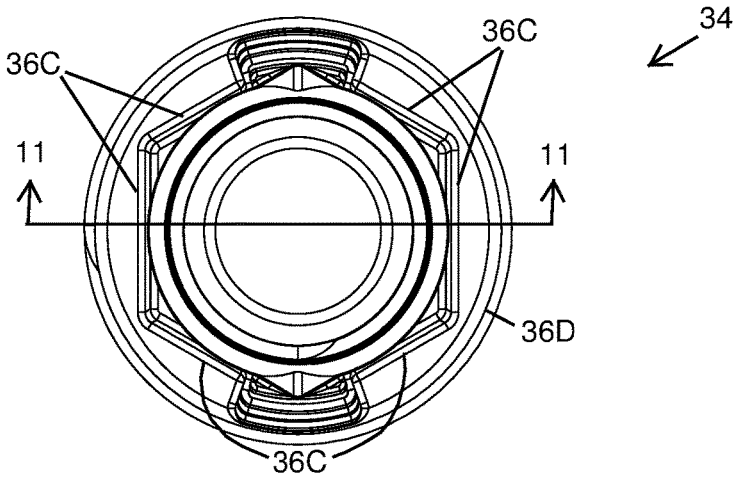
FIG. 9 is a first end view of the connector from FIG. 2.
Figure 10:
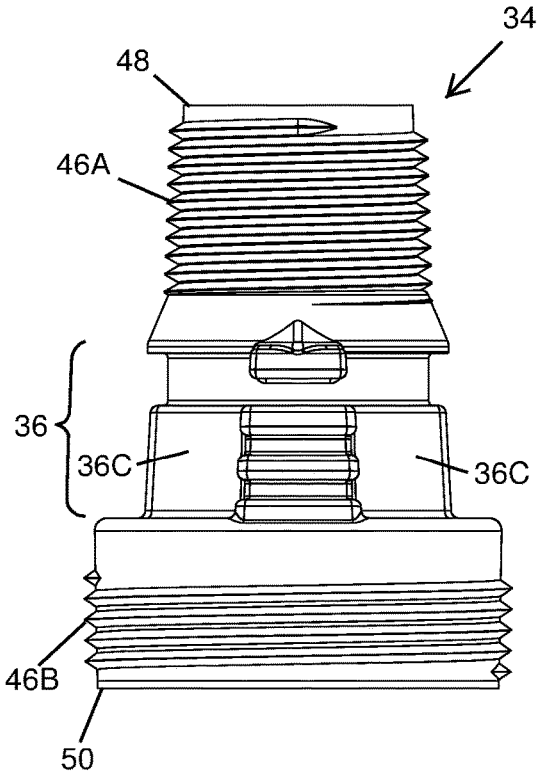
FIG. 10 is a side view of the connector from FIG. 9.
Figure 11:
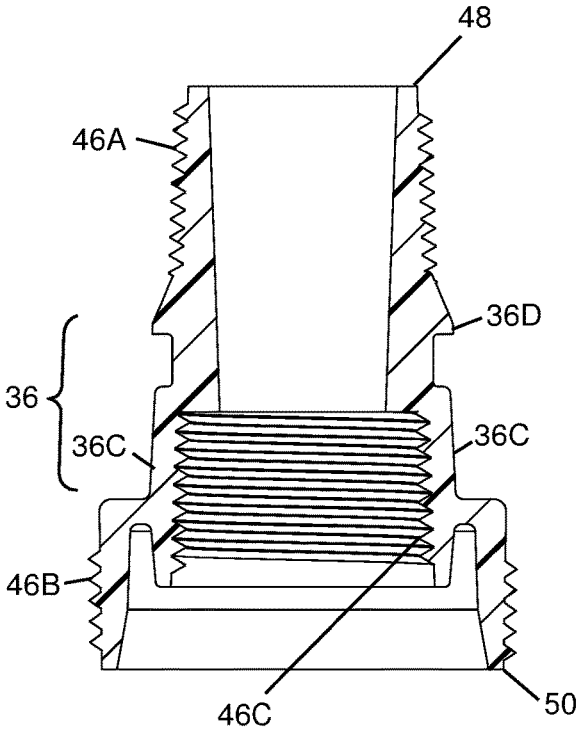
FIG. 11 is a cross-section view of the connector from FIG. 9.

FIG. 9 is a first end view of the connector 34 from FIG. 2. FIG. 10 is a side view of the connector 34 from FIG. 9. FIG. 11 is a cross-section view of the connector 34 from FIG. 9. As shown in the embodiment illustrated in FIGS. 9-11, the connector 34 can include a flat surface 36C to prevent rotation of the connector 34 relative to another flat surface 36C on the shell 32. In the illustrated embodiment, the connector 34 includes a plurality of flat surfaces 36C forming a hex shape. Of course the connector 34 can include more or less that six flat surfaces 36C as is illustrated in FIG. 9.

As shown in the embodiment illustrated in FIGS. 9-11, the connector 34 can include a barb 36D that is configured to be pressed past a lip 36E on the shell 32 and inhibit or prevent relative movement between the connector 34 and the shell 32 in at least one direction (e.g., rotational clockwise, rotational counterclockwise, longitudinal distal, and longitudinal proximal). In certain embodiments, the barb 36D forms a discontinuous shape around a circumference of the connector 34. In certain other embodiments, the barb 36D forms a continuous shape around the circumference of the connector 34.

Figure 12:
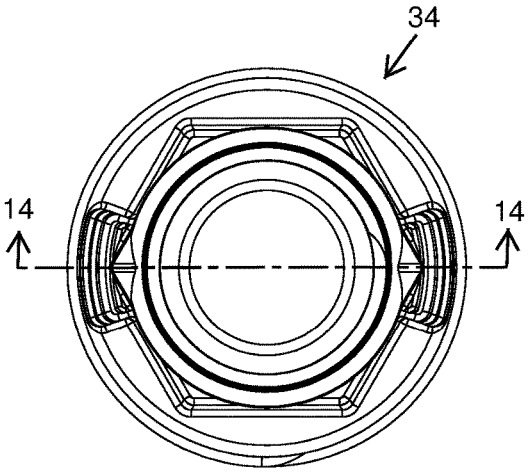
FIG. 12 is another first end view of the connector from FIG. 2 with the connector rotated 90 degrees relative to FIG. 9.
Figure 13:
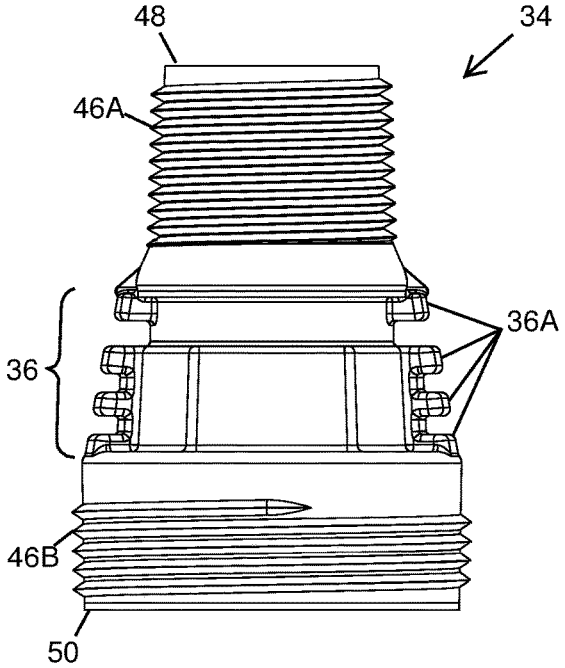
FIG. 13 is a side view of the connector from FIG. 12.
Figure 14:
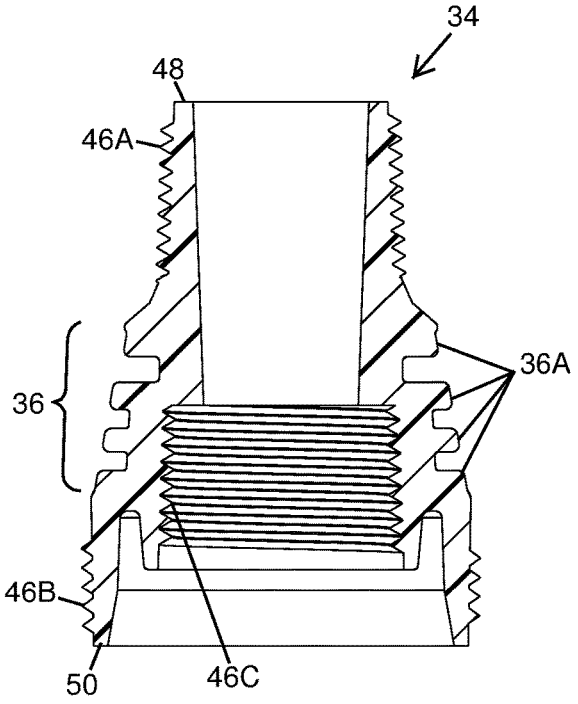
FIG. 14 is a cross-section view of the connector from FIG. 12.

FIG. 12 is another first end view of the connector 34 from FIG. 2 with the connector 34 rotated 90 degrees relative to FIG. 9. FIG. 13 is a side view of the connector 34 from FIG. 12. FIG. 14 is a cross-section view of the connector 34 from FIG. 12. As shown in the embodiment illustrated in FIGS. 12-14, the connector 34 can include the one or more ribs 36A to inhibit relative movement between the connector 34 and the shell 32 in at least one direction (e.g., rotational clockwise, rotational counterclockwise, longitudinal distal, and longitudinal proximal). In the illustrated embodiment, the connector 34 includes two rows of ribs 36A spaced 180 degrees apart with each row generally aligned with a direction of the passageway 52. Of course the connector 34 can include more or less rows of ribs 36A and/or more or less ribs 36A in each row than is illustrated in FIG. 13.

Figure 15:
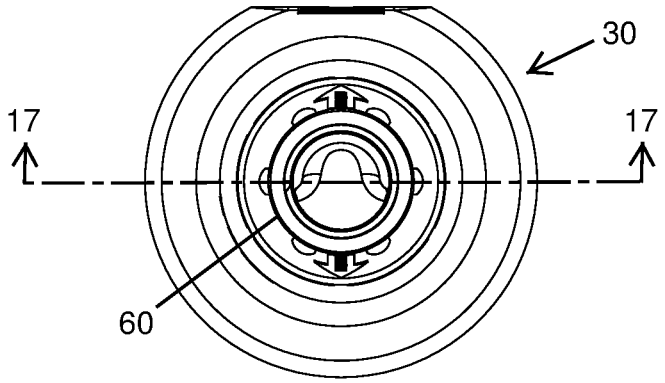
FIG. 15 is a first end view of a sprinkler assembly that includes the weight from FIG. 2 connected between a pressure regulator and a sprinkler.
Figure 16:
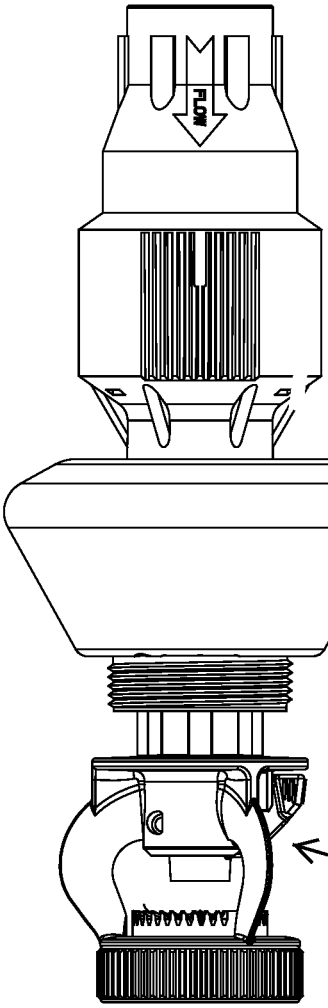
FIG. 16 is a side view of the sprinkler assembly from FIG. 15.
Figure 17:
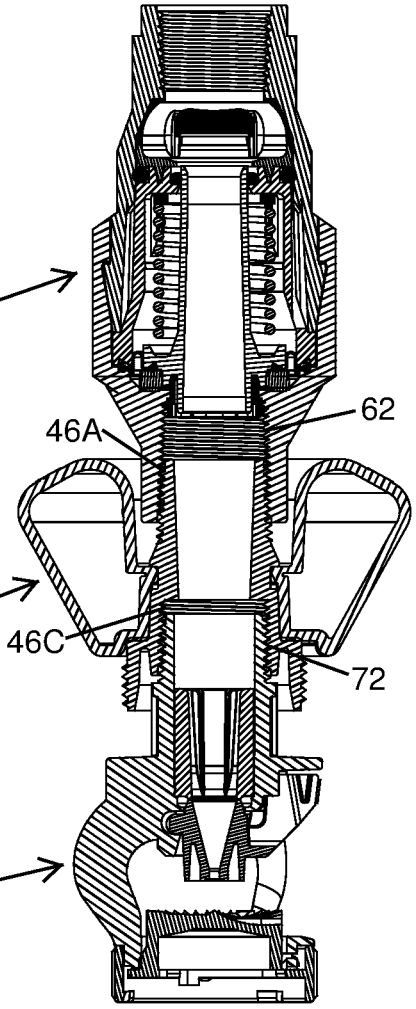
FIG. 17 is a cross-section view of the sprinkler assembly from FIG. 15.

FIG. 15 is a first end view of a sprinkler assembly that includes the weight 30 from FIG. 2 connected between a pressure regulator 60 and a first embodiment of a sprinkler 70 to form the sprinkler assembly. FIG. 16 is a side view of the sprinkler assembly from FIG. 15. FIG. 17 is a cross-section view of the sprinkler assembly from FIG. 15. As is illustrated in FIG. 17, the pressure regulator 60 comprises coupling 62 while the sprinkler 70 comprises coupling 72.

As illustrated in FIG. 17, the coupling 46A on the first end 48 of the connector 34 is engaged with the coupling 62 on the pressure regulator 60 while the coupling 46C on the second end 50 of the connector 34 is engaged with the coupling 72 on the sprinkler 70. In this way, the water flows from the pressure regulator 60 and through the passageway 52 before entering the sprinkler 70.

Figure 22:
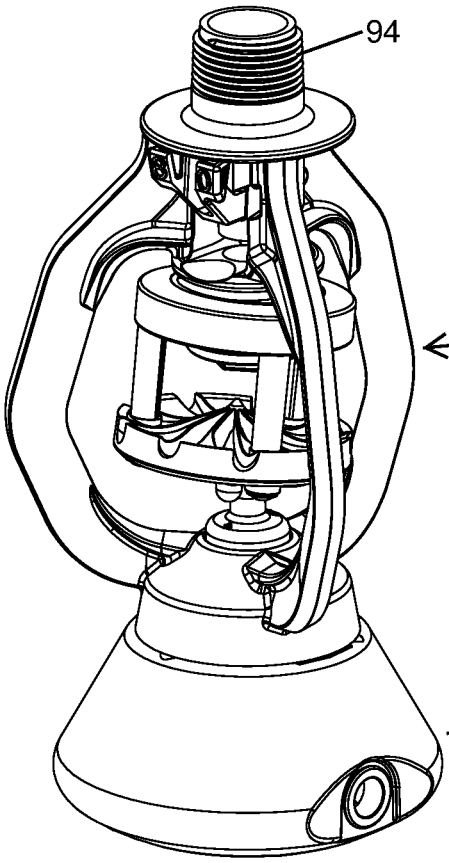
FIG. 22 is a perspective view of the sprinkler assembly from FIG. 21.

In the illustrated embodiment, the weight 30 is considered to be attached upside-down and upstream from the sprinkler 70. For ease of explanation, the weight 30 configuration illustrated in FIG. 22 is considered right-side up.

Figure 18:
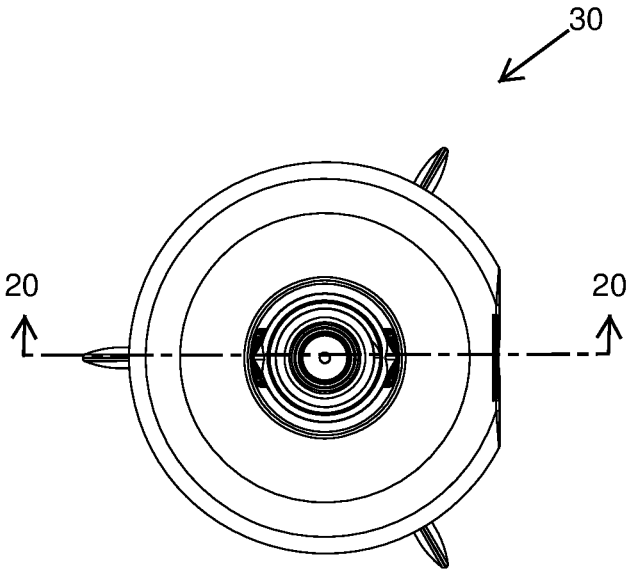
FIG. 18 is a first end view of another sprinkler assembly that includes the weight from FIG. 2 connected upstream from a sprinkler that is different from the sprinkler illustrated in FIG. 16.
Figure 19:
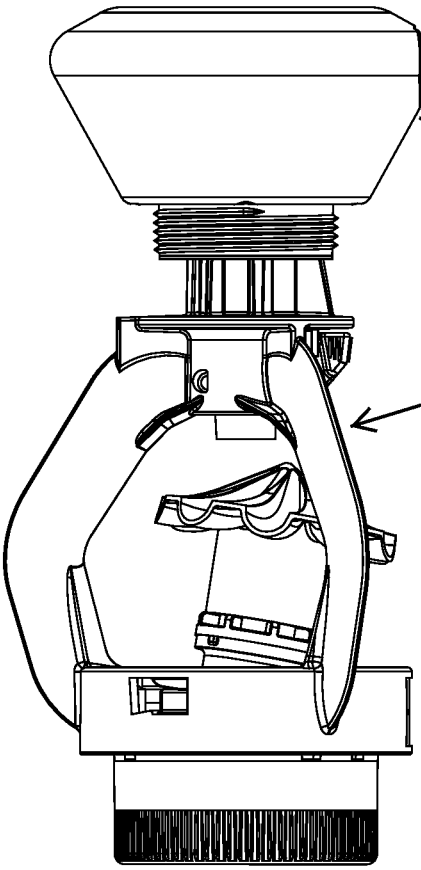
FIG. 19 is a side view of the sprinkler assembly from FIG. 18.
Figure 20:
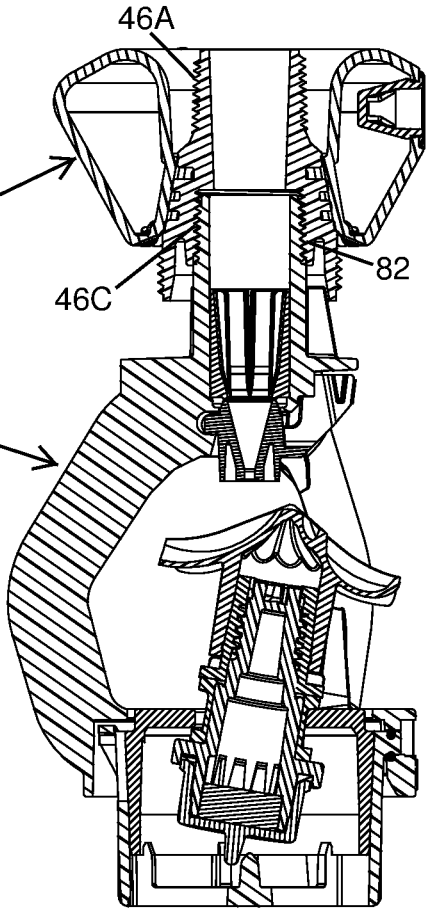
FIG. 20 is a cross-section view of the sprinkler assembly from FIG. 18.

FIG. 18 is a first end view of another sprinkler assembly that includes the weight 30 from FIG. 2 connected upstream from a second embodiment of a sprinkler 80. The sprinkler 80 is different from the sprinkler 70 illustrated in FIG. 16. FIG. 19 is a side view of the sprinkler assembly from FIG. 18. FIG. 20 is a cross-section view of the sprinkler assembly from FIG. 18. As is illustrated in FIG. 20, the sprinkler 80 comprises coupling 82.

As illustrated in FIG. 20, the coupling 46A on the first end 48 of the connector 34 is accessible for connecting to another apparatus such as, for example, a pressure regulator, valve, or water line. The coupling 46C on the second end 50 of the connector 34 is engaged with the coupling 82 on the sprinkler 80. In this way, the water flows through the passageway 52 before entering the sprinkler 80. In the illustrated embodiment, the weight 30 is considered to be attached upside-down and upstream from the sprinkler 80.

Figure 21:
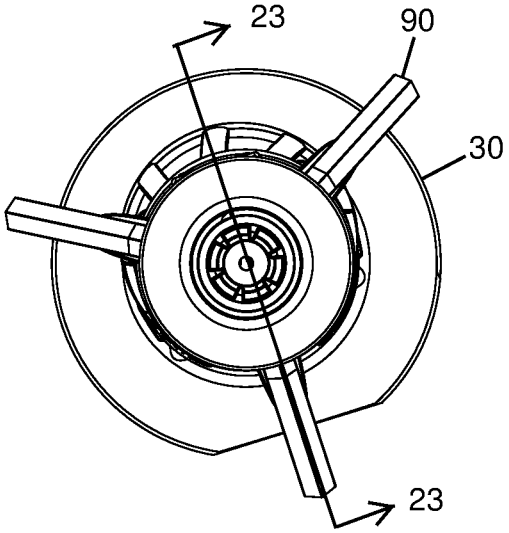
FIG. 21 is a first end view of another sprinkler assembly that includes the weight from FIG. 2 connected downstream of a sprinkler that is different from the sprinklers illustrated in FIGS. 16 and 19.
Figure 23:
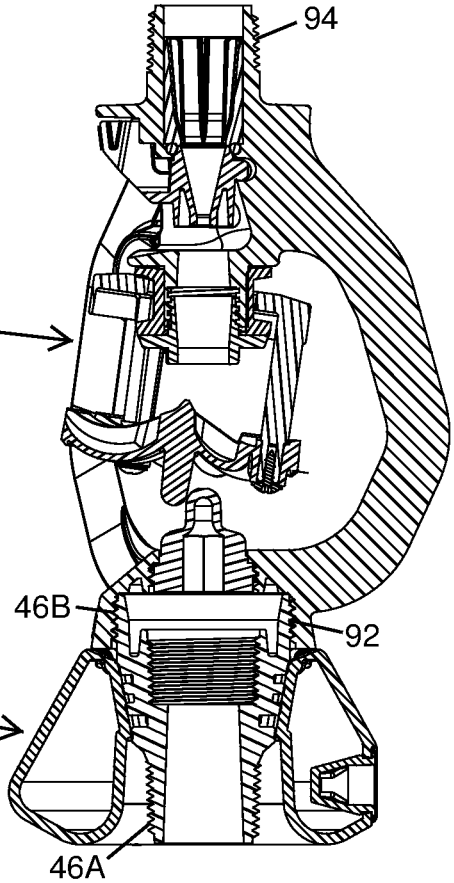
FIG. 23 is a cross-section view of the sprinkler assembly from FIG. 21.

FIG. 21 is a first end view of another sprinkler assembly that includes the weight 30 from FIG. 2 connected downstream of a sprinkler 90 that is different from the sprinklers 70, 80 illustrated in FIGS. 16 and 19, respectively. FIG. 22 is a perspective view of the sprinkler assembly from FIG. 21. FIG. 23 is a cross-section view of the sprinkler assembly from FIG. 21. As is illustrated in FIG. 23, the sprinkler 90 comprises coupling 92 on a bottom end of the sprinkler 90 and coupling 94 on a top end of the sprinkler 90. The coupling 94 is disposed on an inlet to the sprinkler 90.

As illustrated in FIG. 23, the coupling 46B on the second end 50 of the connector 34 is engaged with the coupling 92 on the sprinkler 90. In such an arrangement, the water does not flow through the passageway 52 as the weight 30 is attached to the bottom end of the sprinkler 90. In the illustrated embodiment, the weight 30 is considered to be attached right-side up and below the sprinkler 90.

Alternatively, the weight 30 could be disengaged from the coupling 92, turned upside down, and then re-coupled to the top end of the sprinkler 90 at the coupling 94. In this alternatively arrangement, the coupling 46A on the weight 30 would connect with the coupling 94 on the sprinkler 90 allowing the water to flow through the passageway 52 before entering the inlet to the sprinkler 90.

Figure 25:
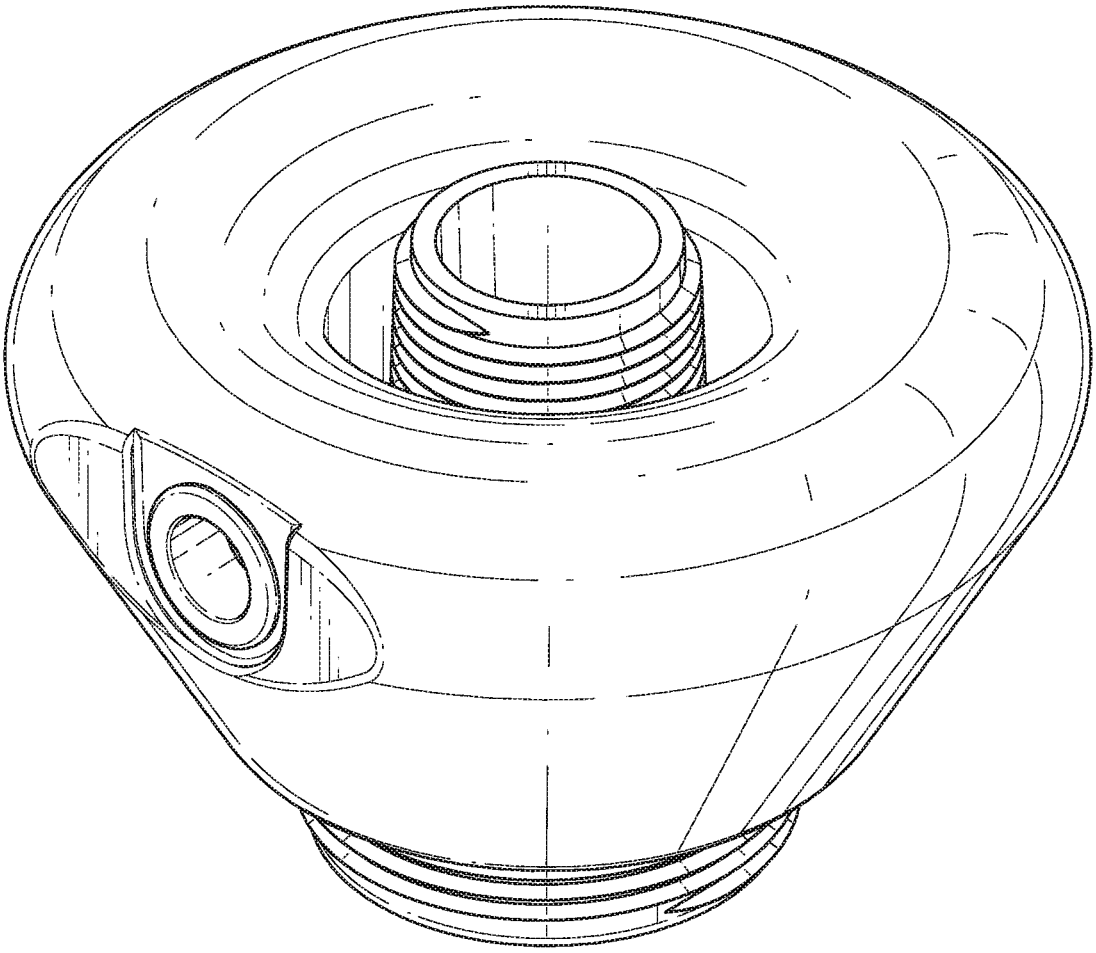
FIG. 25 is a perspective view of an embodiment of a weight.
Figure 26:
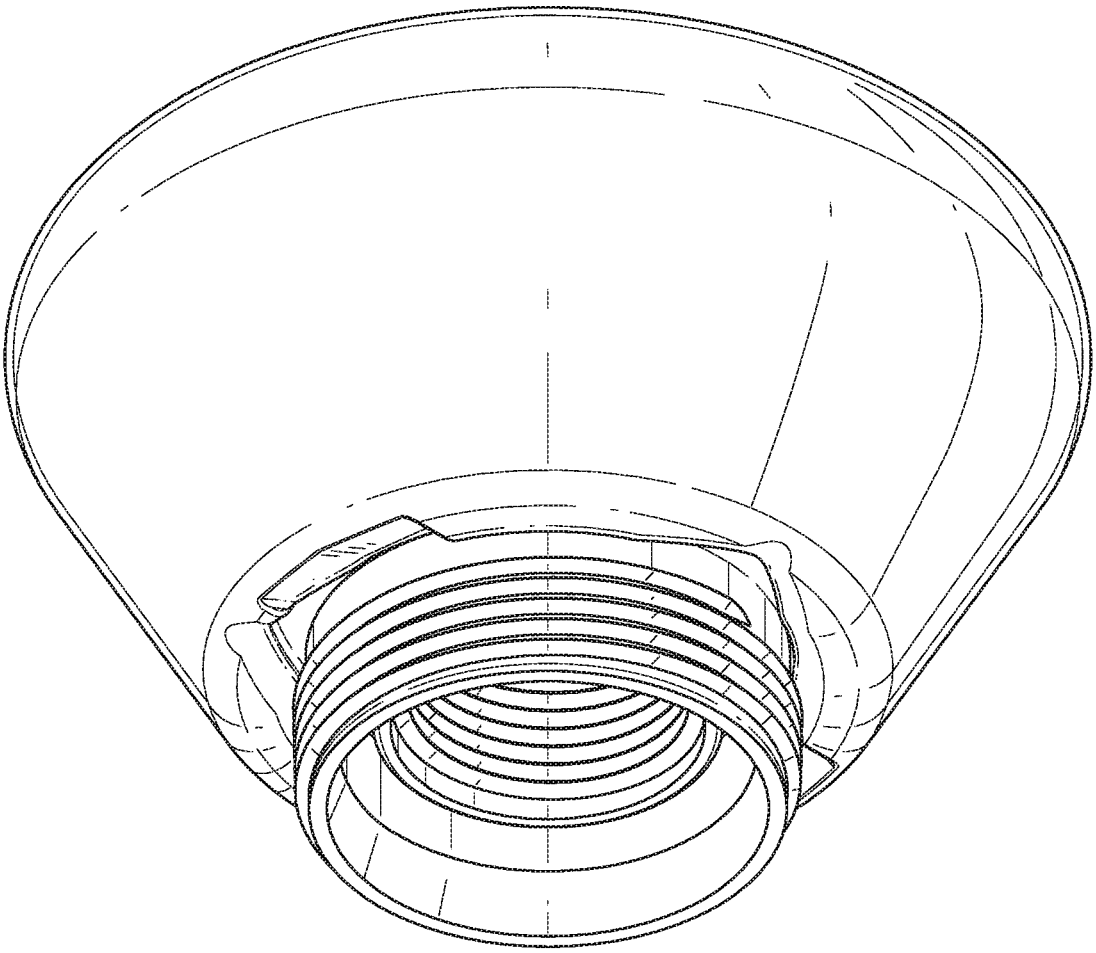
FIG. 26 is another perspective view of the weight of FIG. 25.
Figure 27:
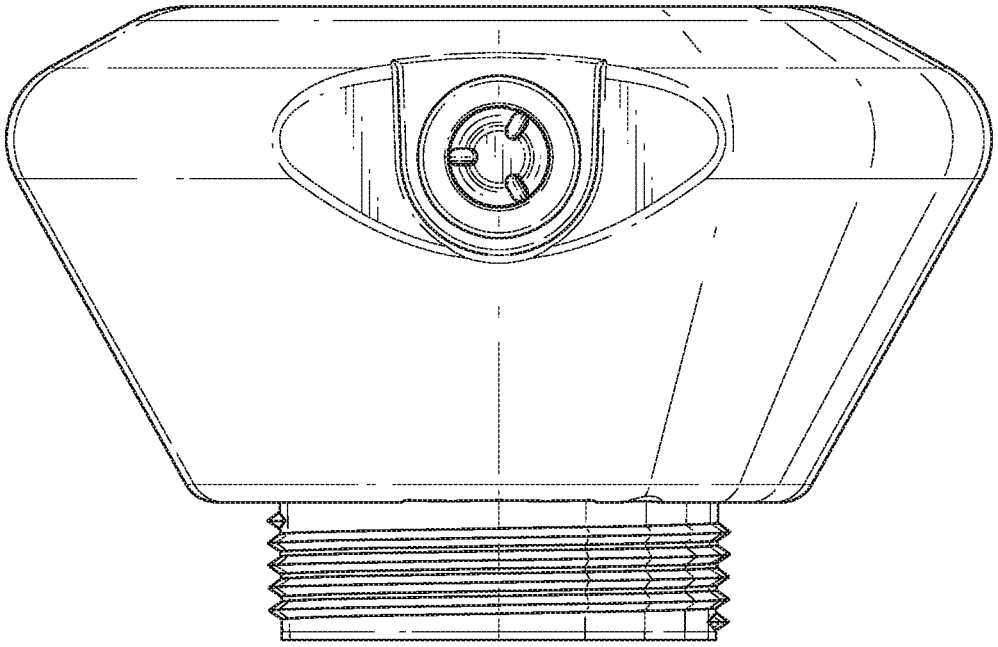
FIG. 27 is a front plan view of the weight of FIG. 25.
Figure 28:
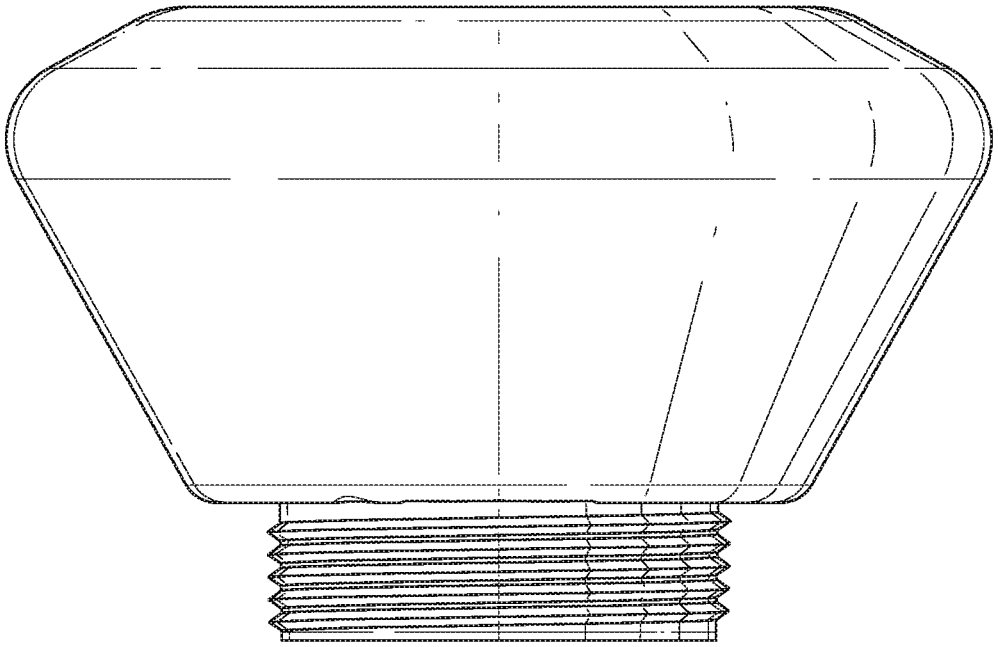
FIG. 28 is a back plan view of the weight of FIG. 25.
Figure 29:
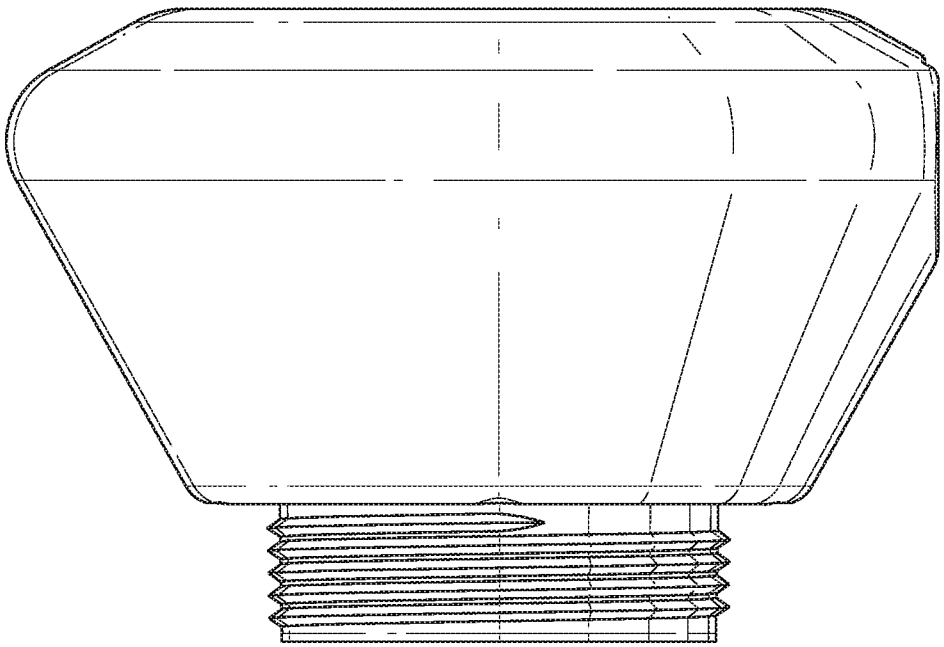
FIG. 29 is a left-side plan view of the weight of FIG. 25.
Figure 30:
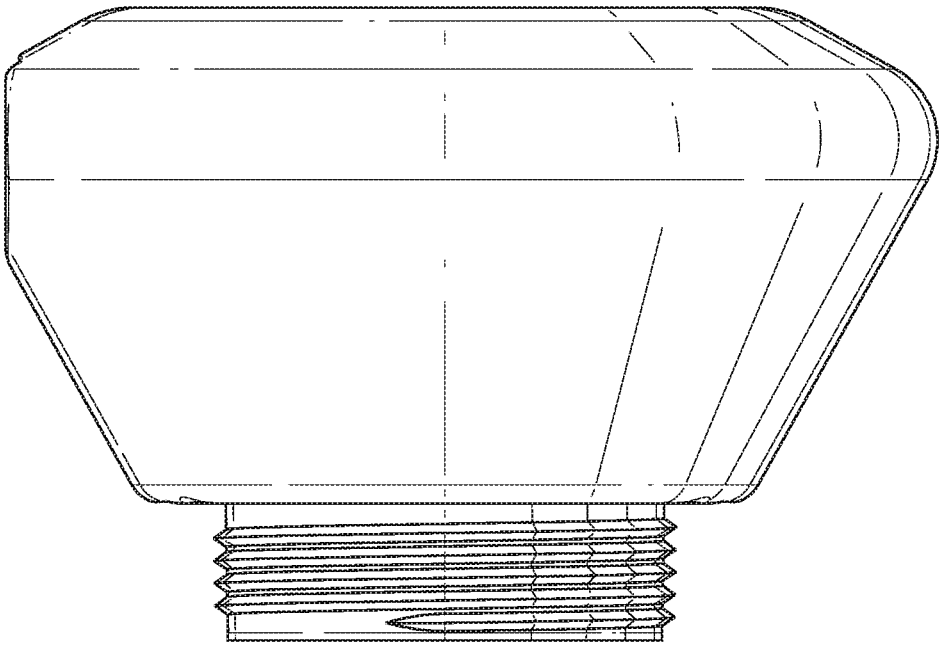
FIG. 30 is a right-side plan view of the weight of FIG. 25.
Figure 31:
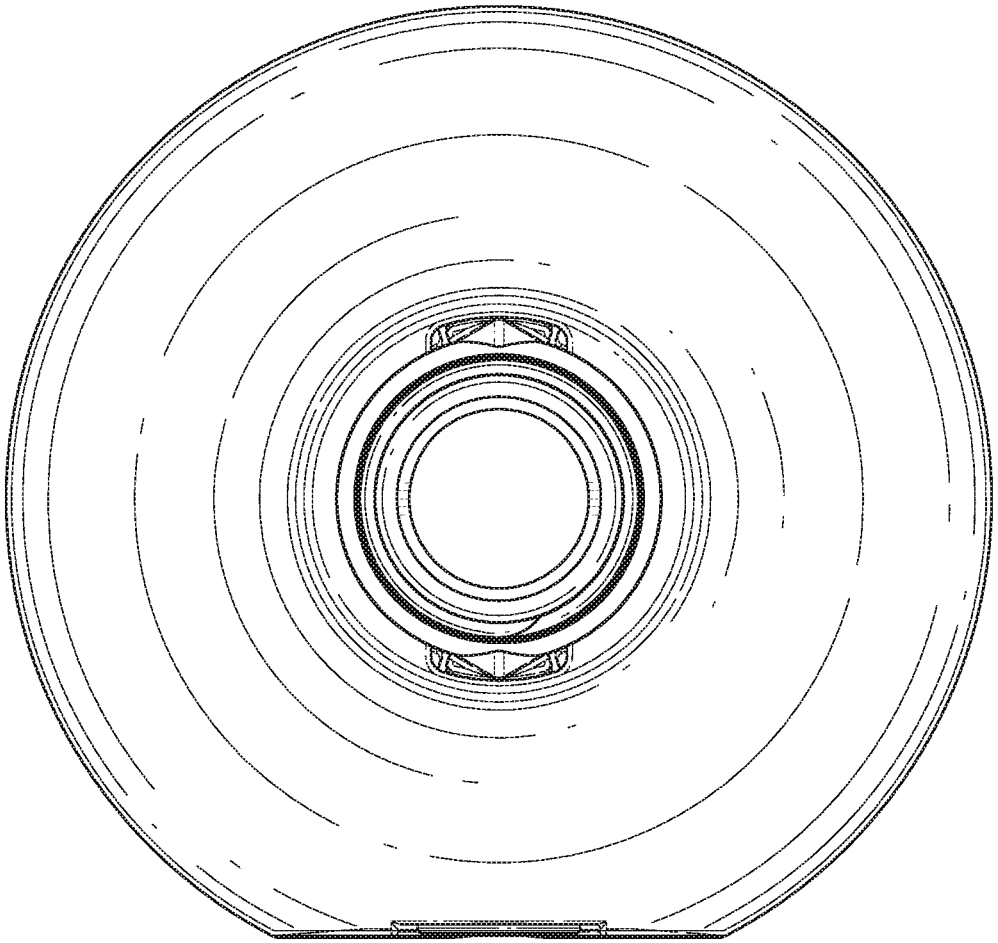
FIG. 31 is a top plan view of the weight of FIG. 25.
Figure 32:
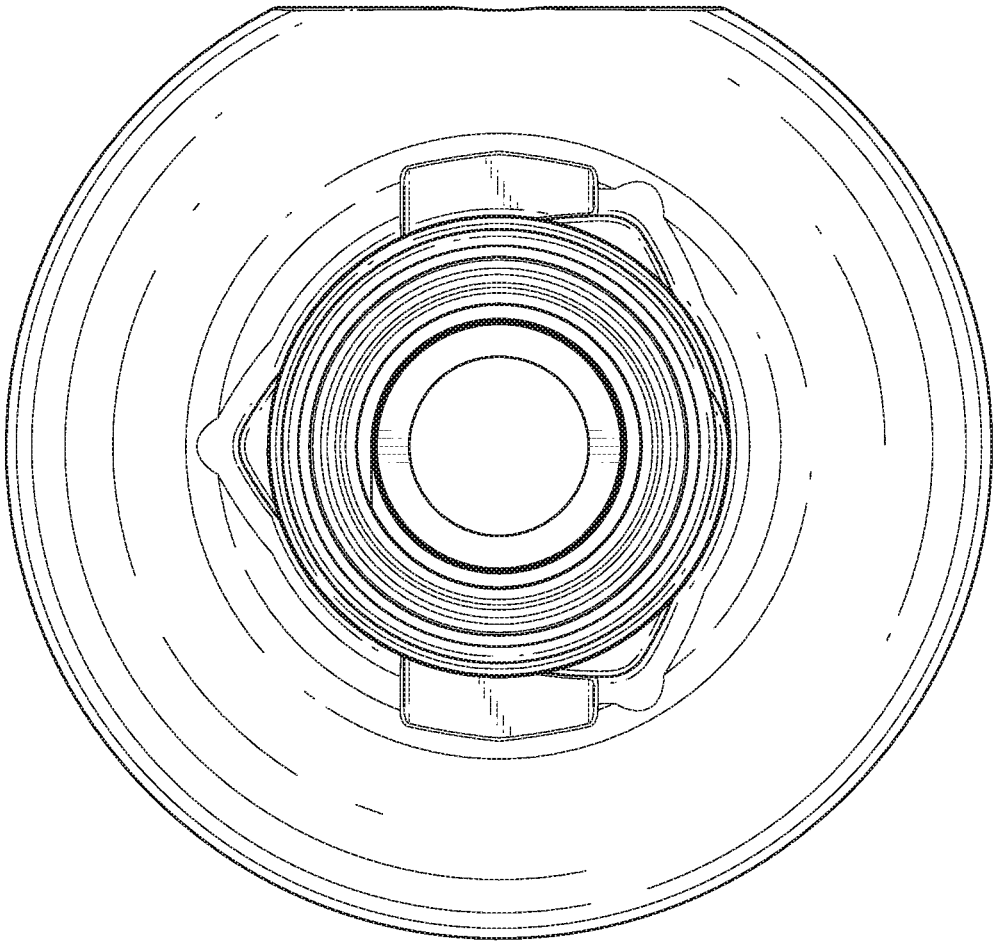
FIG. 32 is a bottom plan view of the weight of FIG. 25.

FIGS. 25-32 illustrate an embodiment of the weight 30. Specifically, FIGS. 25 and 26 are perspective views of the weight 30. FIG. 27 is a front plan view of the weight of FIG. 25. FIG. 28 is a back plan view of the weight of FIG. 25. FIG. 29 is a left-side plan view of the weight of FIG. 25. FIG. 30 is a right-side plan view of the weight of FIG. 25. FIG. 31 is a top plan view of the weight of FIG. 25. FIG. 32 is a bottom plan view of the weight of FIG. 25.

The information in the disclosure and description of the invention itself are illustrative only of the application of the principles of the present invention. Other modifications and alternative embodiments may be devised by those skilled in the art without departing from the spirit and scope of the present invention.

Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Furthermore, the skilled artisan will recognize the interchangeability of different embodiments. For example, various engagement structures disclosed herein, as well as other known equivalents for each such feature, can be mixed and matched by one of ordinary skill in this art to construct the weight in accordance with principles of the present invention.

Although this invention has been disclosed in the context of certain preferred embodiments and examples, it therefore will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims.

What is claimed is:

1. A weight for attaching to a sprinkler, the weight comprising:

a connector having a passageway for water between a first end and a second end, the first end comprising a first coupling, the second end comprising an outer surface and an inner surface, the outer surface comprising a second coupling, the inner surface comprising a third coupling;

a shell having a channel and a chamber, the channel receiving a portion of the connector that is located between the first coupling and the second coupling, the chamber being configured for a user to add weight to or subtract weight from the shell; and an engagement structure disposed on the connector and the shell, the engagement structure at least inhibiting relative movement between the connector and the shell when the portion of the connector is received within the channel of the shell.

2. The weight of claim 1, wherein the engagement structure disposed on the connector is at a location between the first end and the second end.

3. The weight of claim 1, wherein the engagement structure disposed on the shell is at a location in the channel.

4. The weight of claim 1, wherein the first end of the connector comprises an outer surface, and wherein the first coupling is disposed on the outer surface.

5. The weight of claim 1, wherein the first coupling is in a form of at least one barb.

6. The weight of claim 1, wherein the first coupling is in a form of a thread.

7. The weight of claim 6, wherein the first coupling is a ¾ inch male NPT.

8. The weight of claim 1, wherein the second coupling is in a form of a thread.

9. The weight of claim 8, wherein a diameter of the second coupling is greater than ¾ inches.

10. The weight of claim 1, wherein the third coupling is in a form of a thread.

11. The weight of claim 10, wherein the third coupling is a ¾ inch female NPT.

12. The weight of claim 1, wherein the engagement structure at least inhibits relative rotational movement between the connector and the shell when the portion of the connector is received within the channel of the shell.

13. The weight of claim 1, wherein the engagement structure at least inhibits relative longitudinal movement between the connector and the shell when the portion of the connector is received within the channel of the shell.

14. The weight of claim 1, wherein the engagement structure comprises one or more of one or more ribs engaged with one or more slots, a hex shape engaged with a complementary hex shape, a flat surface engaged with a complementary flat surface, or a barb engaged with a lip.

15. A weight for attaching to a sprinkler, the weight comprising:

a first end having a first coupling in a form of a first thread;

a second end having an outer surface and an inner surface, the outer surface comprising a second coupling in a form of a second thread, the inner surface comprising a third coupling in a form of a third thread;

a passageway for water to flow between the first end and the second end; and a chamber configured to confine a material that adds weight.

16. The weight of claim 15, wherein the first coupling is a ¾ inch male NPT, a diameter of the second coupling is greater than ¾ inches, and the third coupling is a ¾ inch female NPT.

17. The weight of claim 15, further comprising a fill port into the chamber, and wherein the material is shot.

18. A weight for attaching to at least a top end and a bottom end of a single sprinkler, the weight comprising:

a first end having a first coupling in a form of a first thread;

a second end having an outer surface and an inner surface, the outer surface comprising a second coupling in a form of a second thread and configured to engage with the bottom end of the sprinkler, the inner surface comprising a third coupling in a form of a third thread and configured to engage with the top end of the sprinkler; and a passageway for water to flow between the first end and the second end.

19. The weight of claim 18, wherein the first end comprises an outer surface, and wherein the first coupling is disposed on the outer surface.

20. The weight of claim 18, wherein the first coupling is a ¾ inch male NPT, a diameter of the second coupling is greater than ¾ inches, and the third coupling is a ¾ inch female NPT.

21. The weight of claim 18, wherein both the first coupling and the third coupling have a first diameter, and wherein the second coupling has a second diameter greater than the first diameter.

* * * * *